United States Patent [19]

Coffey

[11] Patent Number: 4,921,373

[45] Date of Patent: May 1, 1990

[54] BARRIER FOR CONTAINING FLOODS

[76] Inventor: Robert C. Coffey, 11255 Plainfield Rd., Indian Head Park, Ill. 60525

[21] Appl. No.: 281,108

[22] Filed: Dec. 7, 1988

[51] Int. Cl.[5] ..... E02B 7/02; E02B 7/20

[52] U.S. Cl. ..... 405/115; 405/91; 256/13

[58] Field of Search ..... 405/107, 111, 114, 115, 405/91; 404/6; 2/DIG. 6; 256/13

[56] References Cited

U.S. PATENT DOCUMENTS

| | | | |
|---|---|---|---|
| 3,373,568 | 3/1968 | Hornbostel, Jr. | 405/21 |
| 3,886,751 | 6/1975 | Labora | 405/107 |
| 4,136,995 | 1/1979 | Fish | 405/115 |
| 4,279,540 | 7/1981 | Suga et al. | 405/115 |
| 4,298,186 | 11/1981 | Glass | 404/6 X |
| 4,321,774 | 3/1982 | Fish | 52/63 |
| 4,511,286 | 4/1985 | Hardacre | 405/115 |
| 4,602,394 | 7/1986 | Allen et al. | 4/572 X |
| 4,650,368 | 3/1987 | Bayer | 405/111 |
| 4,692,060 | 9/1987 | Jackson, III | 405/91 X |
| 4,714,376 | 12/1987 | Jenab | 405/45 |
| 4,733,990 | 3/1988 | Tsuji et al. | 405/115 |
| 4,784,520 | 11/1988 | Stevens | 405/107 X |

*Primary Examiner*—Randolph A. Reese
*Assistant Examiner*—Arlen L. Olsen
*Attorney, Agent, or Firm*—Thomas W. Speckman; Douglas H. Pauley

[57] ABSTRACT

A fluid containing barrier having a frame with a plurality of legs and a flexible container supported by the frame. The flexible container has a high point vent and a low point drain. The flexible container is capable of holding a fluid. A series of individual frames and flexible containers interlock to form a wall or flood barrier which is used as a dam structure.

23 Claims, 2 Drawing Sheets

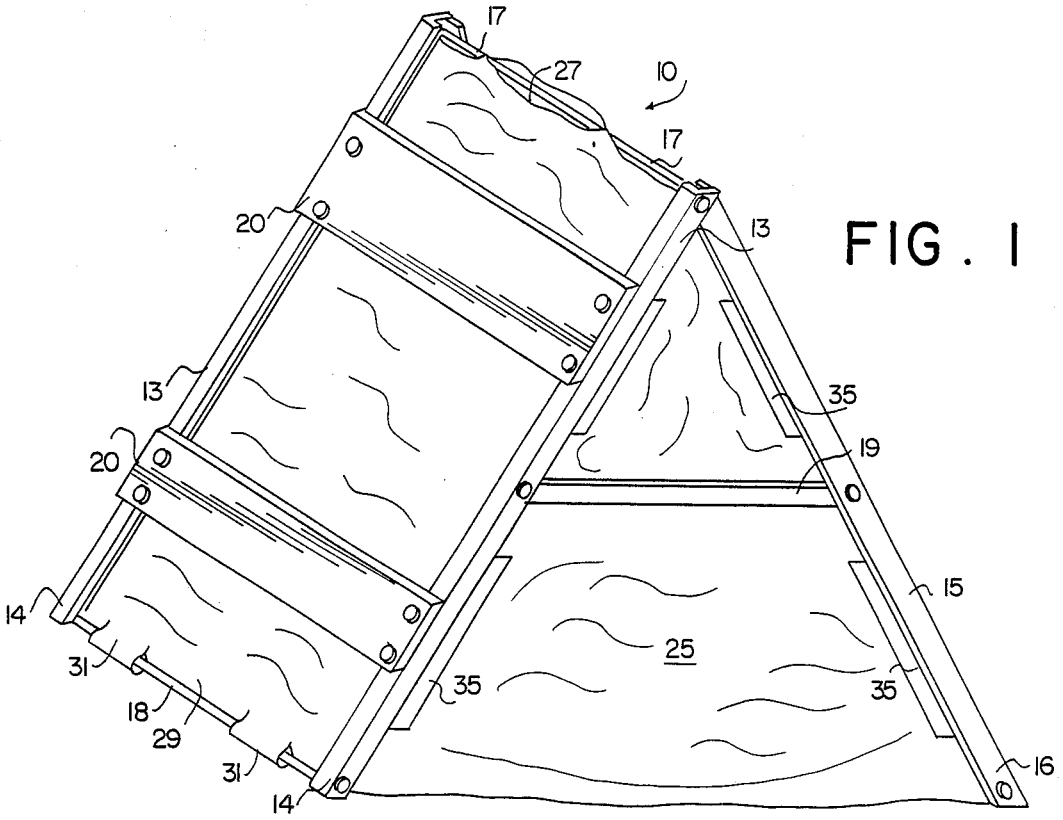
FIG. 1
FIG. 2
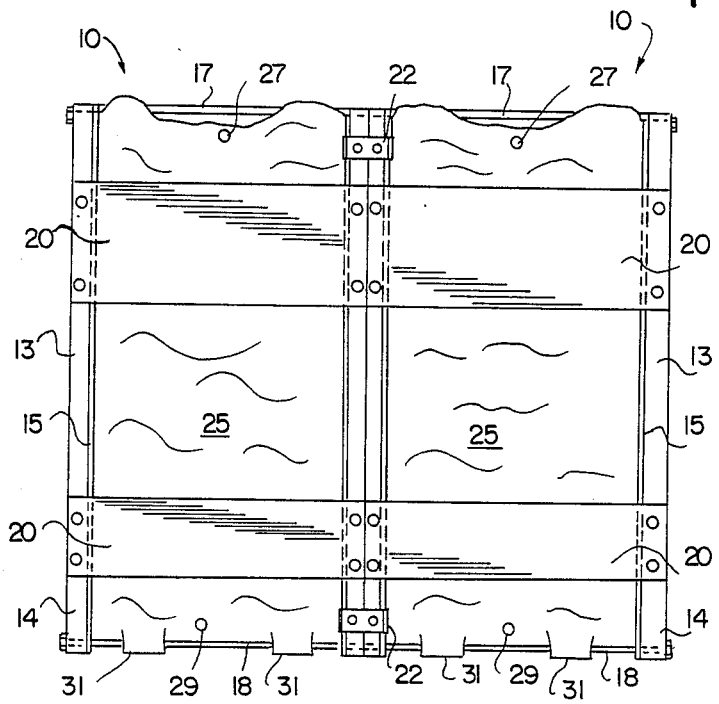

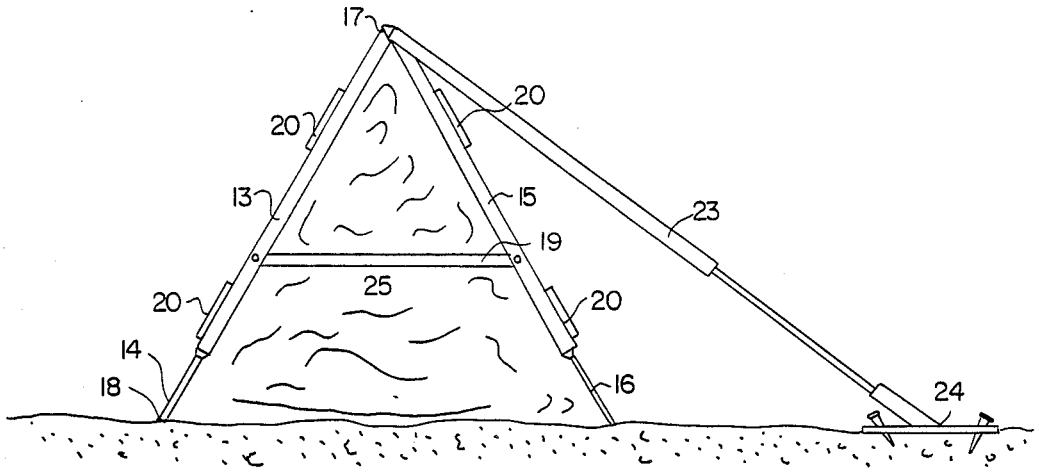
FIG. 3
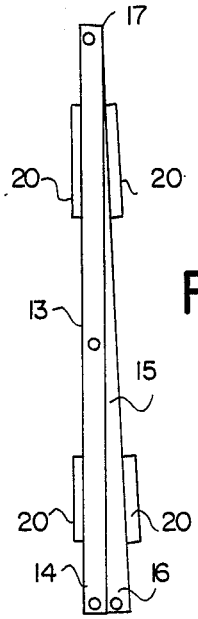
FIG. 4
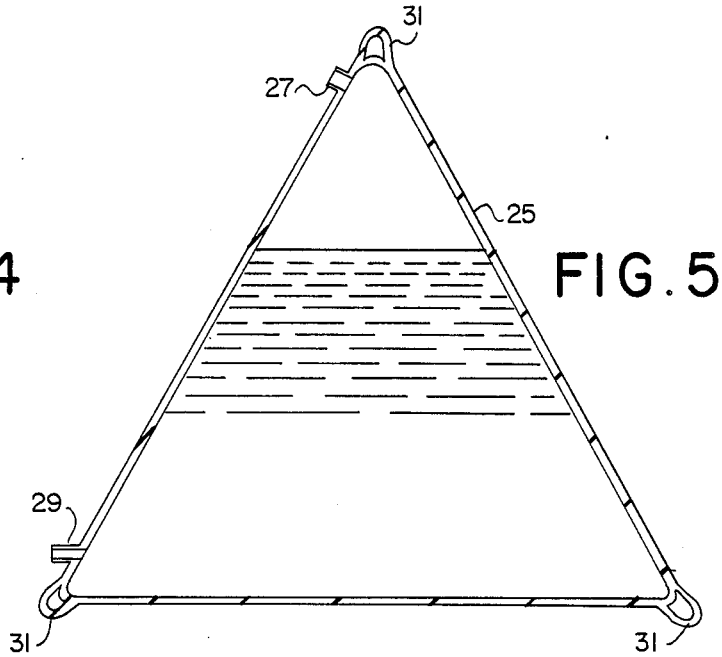
FIG. 5
FIG. 6
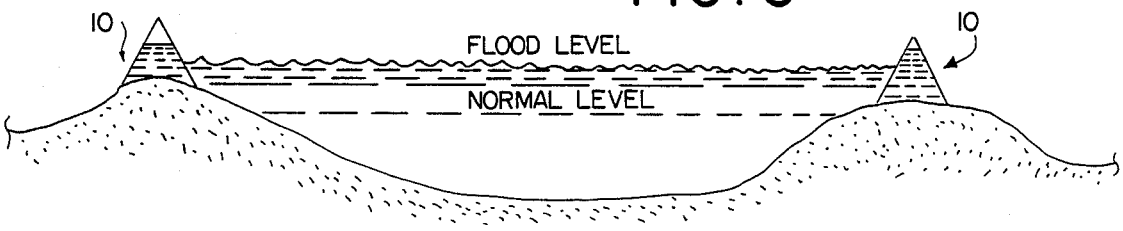

BARRIER FOR CONTAINING FLOODS

BACKGROUND OF THE INVENTION

1. Field of the Invention

This invention relates to a barrier for containing floods. The barrier includes a frame which supports a flexible container having a drain and a vent. A plurality of frames and supported flexible containers are interlocked to form a wall or dam for containing fluids, generally, but not limited to flood water.

2. Description of the Prior Art

Sandbags are commonly used to construct a temporary dam, barrier or wall used to contain flood waters. Sandbags require massive quantities of filler material and intensive manpower. Sandbags also absorb the fluid which it contains and thus can retain pollutants or other harmful or toxic substances.

U.S. Pat. No. 3,373,568 teaches a system for reclamation of land in which a plurality of spaced elongated flexible sealed bags are filled with a mixture of aggregate and water. The bags are spaced apart from each other along a shoreline. The bags can be anchored at each end and positioned in a staggered relation with respect to each other or angularly disposed with respect to the shoreline. The bags act as a breakwater along the shoreline by absorbing energy from the waves and allowing excess water to spill over the top of the bag.

U.S. Pat. No. 3,886,751 teaches a wall formed by a plurality of stacked collapsible bags which are expanded by filling the bags with an aggregate such as sand, rock, gravel, concrete mortar or similar type mixtures. Each bag contains protuberances and indentations for interlocking one bag with respect to another bag. Multiple bags are stacked and interlocked to form a wall which can be used as a dike, levee or other water break or dam structure.

U.S. Pat. No. 4,136,995 discloses a portable dam having a plurality of frame members arranged at spaced intervals across a waterway. A longitudinally pleated and flexible web is draped over angularly inclined ribs. A skirt extends outwardly from the lower marginal edge of the flexible web along the bed of a waterway. A pressure differential between the outer face of the flexible web, which faces away from the frame, and the inner face, which rests on the frame, forces open the pleats of the web and balloons the pleats out to a semicircular configuration and maintains stability of the loaded dam.

U.S. Pat. No. 4,279,540 teaches a collapsible dam having an impermeable flexible membrane which is secured in a watertight manner to the bottom and side walls of a river. The flexible membrane is inflated with either air, water or a combination thereof to vary the overall length of the dam. A plurality of cylindrical units formed by the flexible membrane are sealably connected to the bottom and side walls of a river and to each other in the diametric direction. A prior art weir which is used in a river is disclosed in the '540 patent. The body of the weir is secured at peripheral edges to concrete bases which are formed on the bottom and both side banks of a river. The body is inflated to a certain height which causes the water in the river to dam up to a predetermined level.

U.S. Pat. No. 4,321,774 teaches a flood barrier which extends between opposed side walls of an enclosed space and forms a seal between a floor and side walls. A pleated barrier membrane is secured within the barrier thus providing a dam. U.S. Pat. No. 4,511,286 discloses an interconnectible frame structure that supports a flexible web. The web forms a flexible barrier that acts as a temporary waterway dam. A plurality of pickets driven into the bed of the waterway prevent the frames from sliding back and from sinking into the bed of the waterway.

U.S. Pat. No. 4,650,368 teaches a flood water containment bag constructed of a material which allows liquid to flow from the exterior to the interior of the bag, but does not allow reverse flow. Each bag is filled with an absorbing material that absorbs a large volume of liquid, approximately 100 to 1000 times its own weight. The bags can be fastened to each other to form a wall but it is difficult to release or discharge the water from the bag thus disassembly of the dam is labor intensive. U.S. Pat. No. 4,733,990 discloses a dam which is used in a river or stream. The dam has an inflatable flexible cover sealably attached to a bottom sheet which follows the bottom contour of the waterway. The lower interior surface of the container formed by the bottom sheet and the flexible cover has corrugations between rows of fittings so that in the deflated position, the flexible cover contacts the surface and follows the contour of the corrugations thereby reducing the vertical length of a buoyant and submerged film portion. In such position, the deflated cover will not interfere with ship propellers.

SUMMARY OF THE INVENTION

It is an object of this invention to provide a flood containing barrier that is adapted to conform with irregular or rough terrain, such as terrain on or near the banks of a river.

It is another object of this invention to provide a flood containing barrier which uses flood water or another fluid from the flood as opposed to an aggregate material such as sand or gravel.

It is still another object of this invention to provide a reusable flood containing barrier which can be conveniently and easily stored when not in use.

It is still another object of this invention to provide a flood containing barrier which can be quickly and easily assembled and disassembled in the field.

It is still another object of this invention to provide a flood containing barrier which can be easily cleaned by rinsing away sewage and other pollutants contained in the flood water or other liquid.

It is still another object of this invention to provide a flood containing barrier in which the filler material or flood liquid can be easily disposed.

It is yet another object of this invention to provide a flood containing barrier which can be inexpensively constructed using existing highway or construction barricades.

A barrier according to one embodiment of this invention includes a frame with at least four legs, preferably two front legs and two back legs. Normally, the front legs face the flood water or other liquid and the back legs face a dry side. However, it is apparent that the back legs can face the flood water or other liquid and the front legs can face the dry side. A flexible container or bladder is supported by the frame. The flexible container has at least one drain and at least one vent nozzle secured to a wall of the flexible container. The drain of the flexible container is located at a low point of the flexible container when in an assembled position. At least one vent nozzle is secured to a wall, preferably at a high point, of the flexible container and is in communication with the interior space formed by the flexible container. The flexible container is capable of holding or containing a fluid. It is apparent that the barrier can also be used to separate two or more bodies of liquids, such as oil and water to contain oil spills and the like.

In one embodiment according to this invention, one front leg and one back leg of the frame form an A-frame structure. In a preferred embodiment, at least three cross support members are mounted between the front legs or back legs of two or more A-frame structures. One cross support member is mounted between the vertices of each A-frame structure. Second and third cross support members are each mounted between front bottom portions of front legs and/or between back bottom portions of back legs. In one embodiment according to this invention, an intermediate cross support is secured between the front leg and the back leg of each A-frame structure. In another embodiment according to this invention, at least two legs, front legs and/or back legs, have telescoping sections for adjusting the frame to any irregular or rough terrain.

The lower cross support members extending between two front bottom portions and/or between two back bottom portions of the A-frame structure fit within at least one sleeve secured to a lower edge of at least one front and/or back side wall of the flexible container. In a preferred embodiment, the flexible container has a lower front sleeve and a lower back sleeve that are each mateable with respective lower cross supports and an upper sleeve that is mateable with an upper cross support. The lower and/or upper cross support member mates with the respective sleeve to fix the position of the flexible container with respect to the frame.

In a preferred embodiment of this invention, one frame interlocks with another adjacent frame and one flexible container seals with respect to another adjacent flexible container. A series of interlocked frames and sealed flexible containers form a flood containing barrier wall or dam. The frames can be interlocked with at least one strap, preferably one strap attached to adjacent front legs and another strap attached to adjacent back legs, each strap having one end secured to one frame and another end secured to another frame. Two or more frames can be interlocked at a lower front side, a lower back side, an upper front side, an upper back side, and/or a top section of the frame.

The flexible containers are sealed with respect to each other. The internal pressures created by the fluids in the flexible containers force the walls of the flexible containers outward. Two or more adjacent flexible containers will seal against one another and will conform and seal with respect to the ground due to such outward forces. In addition to such forces, a fabric that can be fastened to itself, such as commercially available Velcro, a zipper or the like is secured to a wall of the flexible container. Such fastener of each flexible container mates with a similar fastener type of another flexible container to assure that the adjacent flexible containers remain positioned next to each other and thus form a proper seal. In a preferred embodiment of this invention, the flexible container is of vinyl coated nylon.

BRIEF DESCRIPTION OF THE DRAWINGS

FIG. 1 shows a perspective view of one frame and one flexible container supported by the frame according to one embodiment of this invention;

FIG. 2 shows a front view of two frames and two flexible containers supported by the frames and interlocked to form a portion of a wall or barrier according to one embodiment of this invention;

FIG. 3 shows a side view of a frame and flexible container supported by the frame according to one embodiment of this invention;

FIG. 4 shows a side view of a folded barrier as shown in FIG. 3;

FIG. 5 shows a cross-sectional side view of a flexible container or bladder according to one embodiment of this invention; and FIG. 6 shows a cross-sectional view of a series of barriers constructed along the banks of a river or stream in a flooded condition.

DESCRIPTION OF PREFERRED EMBODIMENTS

A flood containing barrier or portable liquid barrier 10 according to this invention has several purposes including, but not limited to, containing rising flood waters, separating two or more bodies of liquid, containing oil or chemical spills, containing waters for "fish ponds" at sporting conventions or carnivals, ice skating rinks and the like.

Referring to a preferred embodiment shown in FIG. 1, barrier 10 has a frame with four legs, two front legs 13 and two back legs 15. Flexible container 25 is supported by the frame. In a preferred embodiment, each front leg 13 is hingedly attached at a top portion of a corresponding back leg 15 to form an A-frame structure. Normally, front legs 13 face the flood water or other liquid and back legs 15 face a dry side. However, it is apparent that back legs 15 can face the flood water or other liquid and front legs 13 can face the dry side or in the case of barrier 10 separating two bodies of liquids, both front legs 13 and back legs 15 face a flood water or other liquid.

Legs 15 are preferably connected at the vertex of the A-frame structure with a thru bolt or other suitable hinge mechanism such that the A-frame structure can be folded for storage or transportation. In such folded position, as shown in FIG. 4, the portable A-frame structure preferably has a thickness of approximately 3 to 5 inches. It is apparent that the frame can have two or more legs depending on the mounting surface or terrain. The frame can have two legs if both legs are supported by or against a wall or other similar structure.

In one embodiment according to this invention, at least one upper cross support 17 is secured to and between a vertex of each A-frame structure. Upper cross support 17 and lower cross support 18 can each comprise a rod, a bar or other suitable elongated structural member. In a preferred embodiment, one lower cross support 18 is mounted between two front legs 13, another lower cross support 18 is mounted between two back legs 15, and one upper cross support is mounted between the vertex sections of two A-frame structures. One lower cross support 18 is preferably mounted between at least two front bottom portions 14 and another lower cross support 18 between at least two back bottom portions 16. Each upper cross support 17 or lower cross support 18 can mount within a bracket attached to front leg 13 or back leg 15. In another embodiment, each upper cross support 17 or lower cross support 18 can be an elongated bolt which mounts within through holes in either front leg 13 or back leg 15, and can be secured with a nut or a cotter pin.

At least one horizontal support 19 is secured between one front leg 13 and one back leg 15 of each A-frame structure as shown in FIGS. 1 and 3. It is apparent that horizontal support 19 can be a rigid bar, a strap, a chain or the like. It is also apparent that lower cross support 18 is preferably mounted between two front legs 13 and/or between two back legs 15 so that adjacent lower edges of different flexible containers 25 are free to conform to the ground or terrain and free to seal with respect to the adjacent flexible container 25.

In another embodiment according to this invention, at least one intermediate cross support 20 is mounted between two front legs 13 and two back legs 15. Intermediate cross supports 20 provide barrier 10 with additional strength and rigidity.

In one embodiment according to this invention, at least two legs, either front legs 13 and/or back legs 15 of the frame each have telescoping sections, as shown in FIG. 3, which can be used to adjust the frame and frame-supported flexible container 25 to any irregular or rough terrain. Lower cross supports 18 fit within sleeve 31 of flexible container 25 which is preferably located at a lower edge of at least one side wall of flexible container 25 and sleeve 31 can span the entire length of the lower edge or a portion thereof, as shown in FIGS. 1 and 2. Lower cross support 18 mates with sleeve 31 to secure flexible container 25 with respect to the frame. It is apparent that other rod supports and sleeves, clips or the like can be used to secure flexible container 25 with respect to the frame.

If the flood liquid is in a static condition, a self-supported frame will retain the flood liquid as long as the angle between either front leg 13 or back leg 15 of the A-frame structure, relative to the ground or base surface, is sufficient according to the principles of fluid mechanics, particularly hydrostatic forces on submerged surfaces. If such angles are insufficient to retain the static flood liquid or if the flood liquid is flowing or raging, such as a river, stream, continuous spill or the like, and exerts additional forces on the frame then frame support 23 can be secured to the frame, preferably to the top of the frame as shown in FIG. 3, to provide additional support or reinforcement. It is apparent that frame support 23 can be secured to any other portion of the frame. Support 23 can also comprise telescoping sections, as shown in FIG. 3. Frame support plate 24 is secured to the free end of frame support 23 and can be used to secure frame support 23 with respect to the ground, wall or other support structure. It is apparent that frame support 23 can be secured with respect to the ground, wall or other support structure by other suitable methods known to the art.

A series of frames are interlocked adjacent each other to form a barrier wall or dam structure. The frames are interlocked by having at least one strap 22 secured to one frame and other end of strap 22 secured to another frame. It is apparent that strap 22 can be replaced with a chain, hook and eyelet, clamp or other interlocking mechanism which can be used to interlock two or more frames.

According to a preferred embodiment of this invention, at least one drain 29 is located at a low point of flexible container 25, in its assembled position. Normally, drain 29 is located on the side of the frame facing the flood water or other liquid so that when the flood condition recedes, flexible container 25 can be emptied back into the river, flood water or other liquid. However, drain 29 will operate the same on either side of the frame or both sides of the frame. At least one vent nozzle 27 is secured to a wall at the high point of flexible container 25. Vent nozzle 27 is in communication with an interior space formed by flexible container 25. It is apparent that vent nozzle 27 can be replaced by an open top on flexible container 25, or any other valve or nozzle mechanism used to relieve pressure from flexible container 25 as it is filled with a fluid.

In an assembled position of a series of barriers 10, each flexible container 25 is sealed with respect to an adjacent flexible container 25. The internal pressure due to the fluid static head within flexible container 25 forces the walls of flexible container 25 outward. Adjacent flexible containers 25 abut walls and thus form a seal which prevents flood water or other liquids from flowing from a front side to a back side of barrier 10. In addition to such abutting seal, each flexible container 25 preferably has a strip of fabric 35 secured to the wall of flexible container 25. Fabric 35 is a fabric that can be fastened to itself, such as commercially available Velcro. It is apparent that tape, zippers or other suitable fastening devices can be used in lieu of fabric 35 to assure that adjacent flexible containers 25 remain positioned next to each other and thus form a proper seal between two or more adjacent flexible containers 25.

According to one embodiment of this invention, flexible container 25 is a bladder-like container constructed of a flexible, resilient and expandable material, preferably vinyl coated nylon. Such flexible container 25 can be easily washed or rinsed to remove any pollutants or hazardous or toxic materials that remain after the flood liquid recedes.

Although barrier 10 is preferably used to contain flood water, it is apparent that barriers 10 can be used to contain any other suitable liquid. Flexible containers 25 can be filled with flood water or other liquid from the flood by pumping such liquid from a rising river, stream or other body of water or the like into flexible container 25. It is also apparent that flexible containers 25 can be filled with fresh water such as water from a well system, city water or the like. In order to prevent flood fluid from flowing over or through a dam structure of barricades 10, each flexible container 25 is preferably filled to a level at or above the level of the flood liquid. It is also apparent that custom frames can be built for each flexible container 25 or existing construction or traffic barricades can be retrofitted to support flexible container 25.

Barrier 10 according to this invention reduces the costs associated with necessary labor and materials in constructing a water barricade, dam or the like, for example around a house or other dwelling, along a river bank, around a storage tank in a refinery, food or other processing plant, or the like. FIG. 6 shows a cross-sectional view of a series of barriers 10 constructed along the banks of a river or stream to contain rising flood waters. It is apparent that the size of barrier 10 varies as a function of the depth of the liquid being contained. Whereas a 100 foot sandbag wall requires approximately 1000 sandbags, only approximately 50 carriers 10 according to this invention would be required to build a wall of equal length and height. A four-person crew can construct a 100 foot wall of barriers 10 in less than approximately two hours. The filler material or fluid within each flexible container 25 can be discharged simply by opening drain 29. One person can disassemble a wall of barriers 10 in a relatively short time period.

The frame elements and other structural elements of barriers 10 according to this invention can be constructed from durable materials such as steel, plastic, fiberglass, wood or other suitable materials known in the art.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A barrier for containing floods comprising a plurality of interlocked portable liquid barriers, each said portable liquid barrier comprising: a structural frame having at least two A-frame structures, each said structural frame being collapsible by each said A-frame structure having a front leg and a back leg hingedly mounted with respect to each other at an apex section of each said A-frame structure, at least one cross support secured between apex sections of said at least two A-frame structures, at least one horizontal support secured between said front leg and said back leg of each said A-frame structure; a flexible container supported by said structural frame, said flexible container having drain means and vent means, said flexible container capable of holding a fluid; frame interlock means for interlocking adjacent said legs of each said A-frame of said portable liquid barriers, and flexible container fastening means for fastening adjacent said flexible containers; and at least two of said front legs and said back legs of each said structural frame each having downwardly telescoping means for adjusting said structural frame to an irregular terrain.

2. A barrier according to claim 1 further comprising an elongated frame support having one end secured to said apex section of at least one of said apex sections and an opposite end secured to structural frame support means.

3. A barrier according to claim 1 further comprising a first lower cross support member secured between two front bottom portions of said front legs of said structural frame and a second lower cross support member secured between two back bottom portions of said back legs of said structural frame.

4. A barrier according to claim 1 further comprising at least one intermediate cross support secured between said front legs of said structural frame.

5. A barrier according to claim 1 further comprising at least one intermediate cross support secured between said back legs of said structural frame.

6. A barrier according to claim 1 wherein each said A-frame structure collapses to an overall thickness of about 3 inches to about 5 inches.

7. A barrier according to claim 1 further comprising: each said front leg and each said back leg of each said A-frame structure having holding means, said flexible container having at least one sleeve located at a lower edge of at least one side wall of said flexible container, said holding means mateable with each said sleeve to secure said flexible container with respect to said structural frame.

8. A barrier according to claim 7 further comprising a lower front said sleeve of said flexible container and a lower back said sleeve of said flexible container each mateable with said holding means.

9. A barrier according to claim 1 wherein said frame interlock means further comprise at least one strap, each said strap securing said structural frames relative to each other.

10. A barrier according to claim 1 wherein said drain means further comprise at least one drain valve located at a low point of said flexible container when in an assembled position.

11. A barrier according to claim 1 wherein said vent means is located at a high point of said flexible container when in an assembled position.

12. A barrier according to claim 1 wherein said vent means further comprise at least one vent nozzle secured to a high point of a wall of said flexible container and in communication with an interior space formed by said flexible container.

13. A barrier according to claim 1 wherein said flexible container sealing means further comprise a fabric that can be fastened to itself, said fabric secured to a wall of said flexible container.

14. A barrier according to claim 1 wherein said flexible container further comprises vinyl coated nylon.

15. A barrier for containing floods comprising a plurality of interlocked portable fluid barriers, each said portable fluid barrier of the type having a frame, the improvement comprising: a plurality of flexible containers each supported by each of the frames, each said flexible container having drain means and vent means, each said flexible container capable of holding a liquid; frame interlock means for interlocking adjacent legs of a plurality of legs of each of the frames, and flexible container fastening means for fastening adjacent said flexible containers; and at least two said legs of each of the frames each having downwardly telescoping means for adjusting the frames to an irregular terrain.

16. A barrier according to claim 15, further comprising: said legs of each frame having holding means, said flexible container having at least one sleeve located at a lower edge of at least one side wall of each said flexible container, said holding means mateable with each said sleeve to secure each said flexible container with respect to each said frame.

17. A barrier according to claim 15 further comprising a lower front said sleeve of each said flexible container and a lower back said sleeve of each said flexible container each mateable with said holding means.

18. A barrier according to claim 15 wherein said drain means further comprise at least one drain valve located at a low point of each said flexible container when in an assembled position.

19. A barrier according to claim 15 wherein said vent means is located at a high point of each said flexible container when in an assembled position.

20. A barrier according to claim 15 wherein said vent means further comprise at least one vent nozzle secured to a high point of a wall of each said flexible container and in communication with an interior space formed by each said flexible container.

21. A barrier according to claim 15 wherein each flexible container sealing means further comprise a fabric that can be fastened to itself and said fabric is secured to a wall of each said flexible container.

22. A barrier according to claim 15 wherein said flexible container further comprises vinyl coated nylon.

23. A barrier for containing floods comprising a plurality of interlocked portable liquid barriers, each said portable liquid barrier comprising: a structural frame having at least two A-frame structures, each said structural frame being collapsible by each said A-frame structure having a front leg and a back leg hingedly mounted with respect to each other at an apex section of each said A-frame structure, at least one cross support secured between apex sections of said at least two A-frame structures, at least one horizontal support secured between said front leg and said back leg of each said A-frame structure; a flexible container supported by said structural frame, said flexible container having drain means and vent means, said flexible container capable of holding a fluid; frame interlock means for interlocking adjacent said legs of each said A-frame of said portable liquid barriers, and flexible container fastening means for fastening adjacent said flexible containers; and an elongated frame support having one end secured to said apex section of at least one of said apex sections and an opposite end secured to structural frame support means.

* * * * *